US007192370B2

(12) United States Patent
van der Pols

(10) Patent No.: US 7,192,370 B2
(45) Date of Patent: Mar. 20, 2007

(54) STRING TENSIONING FORCE CONTROLLING APPARATUS FOR A RACKET STRINGER

(76) Inventor: Erik B. van der Pols, 847 San Feng Road, Feng Yuan (TW)

( * ) Notice: Subject to any disclaimer, the term of this patent is extended or adjusted under 35 U.S.C. 154(b) by 708 days.

(21) Appl. No.: 10/211,634

(22) Filed: Aug. 2, 2002

(65) Prior Publication Data

US 2003/0027670 A1 Feb. 6, 2003

(30) Foreign Application Priority Data

Aug. 3, 2001 (TW) ..... 90213210 U

(51) Int. Cl.
*A63B 51/14* (2006.01)

(52) U.S. Cl. ..... 473/557

(58) Field of Classification Search ..... 473/555–557; 73/862.381, 862.393, 862.42–44, 862.473
See application file for complete search history.

(56) References Cited

U.S. PATENT DOCUMENTS 3,635,080 A * 1/1972 Krueger et al. ..... 73/862.43
3,918,713 A * 11/1975 Kaminstein ..... 473/556
5,299,462 A * 4/1994 Key ..... 73/862.391
5,338,028 A * 8/1994 Sung ..... 473/556
5,733,212 A * 3/1998 Wise et al. ..... 473/557
5,820,500 A * 10/1998 Raos ..... 473/557
6,162,139 A * 12/2000 Bassili ..... 473/557
6,227,990 B1 * 5/2001 Wise et al. ..... 473/557
6,583,590 B1 * 6/2003 Chu ..... 318/34
6,712,723 B2 * 3/2004 You ..... 473/557
6,837,811 B1 * 1/2005 Wu ..... 473/557

FOREIGN PATENT DOCUMENTS

GB 2079612 A * 1/1982

* cited by examiner

*Primary Examiner*—Corbett B. Coburn
*Assistant Examiner*—Alex F. R. P. Rada, II
(74) *Attorney, Agent, or Firm*—Rosenberg, Klein & Lee

(57) ABSTRACT

A string tensioning force controlling apparatus for a racket stringer includes a string pulling mechanism having a support housing, a string pulling head movably supported by the support housing for engaging a string, and a drive arrangement drivingly coupled to the string pulling head. The apparatus also includes an encoder disposed adjacent to the string pulling mechanism for sensing displacement of the string pulling head relative to the support housing and generating a digital output signal representative thereof, and a central processing unit for receiving the digital output signal and in response thereto controlling operation of the drive arrangement to move the string pulling head such that a desired tensioning force is accurately applied to the string so as to produce a tensioned string.

24 Claims, 6 Drawing Sheets

STRING TENSIONING FORCE CONTROLLING APPARATUS FOR A RACKET STRINGER

BACKGROUND OF THE INVENTION

1. Field of the Invention

The present invention generally relates to a racket stringer and, more particularly, is concerned with a string tensioning force controlling apparatus for a racket stringer.

2. Description of the Prior Art

A traditional racket stringer has a rock arm onto which weights are manually added. By means of different weights, the rock arm is turned to create different torque for driving a string pulling head to pull and tension a racket string. The racket string is tensioned by different poundage.

Even if, in accordance with the above arrangement, a heavy weight is used to tension the string, the operation by being a substantially manual one, still often results in great error. Moreover, the weights gradationally vary from one another such that the poundage of the tensioned string cannot be micro-adjusted.

One prior art racket stringer employs a motor for driving a gear set to create torque for driving the string pulling head and tensioning the string. The motor, gear set and string pulling head form a string pulling mechanism pivotally disposed on a base seat of the racket stringer. When the string pulling head is turned to pull and tension the string to a certain poundage, the reaction force of the string pulling head will drive a rock member of the string pulling mechanism to swing. This racket stringer also employs a controlling unit which has a sensor (such as a strain meter, a variable resistor or a limit switch) for controlling the motor. The rock member once driven to swing will contact with the sensor. The contact force applied by the swinging rock member with the sensor is detected as the change of the resistant force of the sensor and in response thereto an analog signal is generated and sent to a decoder of the controlling unit for calculating the tensioning force exerted onto the string by the string pulling mechanism.

The sensor which generates the analog signal, such as the strain meter, is likely to produce error due to the change of environmental factors, such as temperature. The decoder of the controlling unit which receives the analog signal converts it into a digital signal for facilitating the calculation of the tensioning force. The decoding procedure carried out by the decoder reproduces the error of the analog signal in the digital signal. Furthermore, generally it is the one end of the rock member distal from the pivoted section that contacts with the sensor. The length of the rock member serves as a force arm for magnifying the collision force. Such design can easily produce error of the value detected by the sensor. This leads to error in the output analog signal generated by the sensor. Thus, the detection measurement provided by the output analog signal contains considerable error so that the pulling tension exerted onto the racket string by the prior art string pulling mechanism cannot be accurately controlled. Another disadvantage to this prior art racket stringer is that the wiring from the sensor moves with the string pulling head while tensioning the string. This can result in premature wear to the sensor wires and eventually they will need to be replaced.

Another prior art string tensioning device known as the "Molstring" under its commercial name, is comprised of a base frame, a gripping drum for gripping the string rotatably mounted to the base frame, a hand crack arrangement for applying tension to string rotatably mounted to the base frame and fixed to the gripping drum, a lever arm fixed to the hand crank arrangement on one end and attached to the base frame on the other end with a biasing spring, where the lever arm is also rotatably mounted to the base frame. An absolute digital encoding device is employed where the sensed member of the encoding device is fixed to the lever arm, and the sensor of the encoding device is fixed to the base frame. As tension is manually applied to the string by turning the hand crank arrangement, the lever rotates relative to the base frame and moves the sensed member of the absolute digital encoder relative to the sensor of the absolute digital encoder to send a signal to a central processing unit and display the tension being applied to the string on an LED display. The tension in the string is controlled manually by observing the LED display and is very difficult to control to achieve the desired tension in the string. Furthermore, the absolute digital encoder has discrete indicators positioned on it such that each signal generated at each indicator is uniquely associated to a discrete and specific tension level being applied to the string and therefore must be perfectly mounted relative to the sensor and perfectly matched to the load verses deflection (spring rate) characteristics of the biasing spring in order to display the correct tension. Due to variations in the spring rate of different springs, the biasing spring is rarely matched perfectly to the discrete indicators on the sensor member, resulting in inaccurate tension display. This makes controlling the tension applied to the string and achieving the desired tension in the string difficult, if not impossible.

Consequently, there is a need for an innovation that will overcome the aforementioned problems without introducing any new problems in place thereof.

SUMMARY OF THE INVENTION

The present invention provides a string tensioning force controlling apparatus for a racket stringer which is designed to satisfy the aforementioned need. The controlling apparatus of the present invention eliminates the various sources of error present in the prior art apparatus by utilizing one or more encoders which sense displacement of the string pulling mechanism and generate digital signals representative thereof. The controlling apparatus of the present invention also utilizes a central processing unit which receives the digital signals from the encoders and controls operation of a motor such that a desired tensioning force is accurately applied and maintained on the racket string.

Accordingly, the present invention is directed to a string tensioning force controlling apparatus for a racket stringer which comprises: (a) a fixed base housing; (b) a string pulling mechanism having a support housing, a drive arrangement supported on said support housing, and a string pulling head adapted to engage a string and mounted on said support housing, said string pulling head also drivingly coupled to said drive arrangement and in response to operation of said drive arrangement adapted to apply a desired tensioning force on the string to produce a tensioned string, said support housing movably mounted on said fixed base housing for undergoing linear displacement relative to said fixed base housing in response to a force of the tensioned string being applied on said support housing via said string pulling head; (c) biasing means disposed between said support housing and said fixed base housing and adapted to bias said support housing to undergo linear displacement toward a first position relative to said base housing and to yield to allow said support housing to undergo linear displacement toward a second position relative to said fixed base housing upon applying said string tension force; (d) detection means disposed adjacent to said string pulling mechanism for detecting the displacement of said string pulling mechanism relative to said fixed base housing and generating an output signal representative of the displacement; and (e) a central processing unit adapted to accept an input instruction representing the desired tensioning force to be applied to the string, and connected to said drive arrangement and to said detection means for receiving the output signal from said detection means and, in response thereto, operating said drive arrangement such that the desired tensioning force is automatically and accurately applied on the string so as to produce the tensioned string.

The present invention is also directed to a string tensioning force controlling apparatus for a racket stringer which comprises: (a) a fixed base housing; (b) a string pulling mechanism having a support housing, a drive arrangement supported on said support housing, and a string pulling head adapted to engage a string and mounted on said support housing, said drive arrangement including a motor mounted to said support housing and having a rotary output shaft drivingly connected to said string pulling head for moving said string pulling head in response to operation of said motor to apply a desired tensioning force on the string to produce a tensioned string, said support housing movably mounted on said fixed base housing for undergoing linear displacement relative to said fixed base housing in response to a force of the tensioned string being applied on said support housing via said string pulling head; (c) biasing means disposed between said support housing and said fixed base housing and adapted to bias said support housing to undergo linear displacement toward a first position relative to said base housing and to yield to allow said support housing to undergo linear displacement toward a second position relative to said fixed base housing upon applying said string tension force; (d) a first incremental digital encoder disposed adjacent to said string pulling mechanism for detecting the linear displacement of said support housing relative to said fixed base housing and generating a first output signal representative of the linear displacement; (e) a second incremental digital encoder disposed adjacent to said string pulling mechanism for detecting the rotational displacement of the output shaft of said motor relative to said support housing and generating a second output signal representative of the rotational displacement; and (f) a central processing unit adapted to accept an input instruction representing the desired tensioning force to be applied to the string, and connected to said drive arrangement and to said first encoder for receiving the first output signal from said first incremental digital encoder and to said second digital incremental encoder for receiving the second output signal from said second digital incremental encoder and, in response thereto, operating and controlling said drive arrangement such that the desired tensioning force is automatically and accurately applied and maintained on the string so as to produce the tensioned string.

Still further, the present invention is directed to (a) a base housing; (b) a string pulling mechanism having a support housing, a string pulling head and a drive arrangement, said string pulling head mounted on said support housing and adapted to engage a string, said drive arrangement including a motor mounted to said support housing and having a rotary output shaft drivingly connected to said string pulling head for moving said string pulling head in response to operation of said motor to apply a desired tensioning force on the string so as to produce a tensioned string; (c) a digital incremental encoder disposed adjacent to said string pulling mechanism for detecting the rotational displacement of the output shaft of said motor relative to said support housing and generating a digital output signal representative of the rotational displacement; and (d) a central processing unit adapted to accept an input instruction representing the desired tensioning force to be applied to the string, and connected to said drive arrangement and to said digital incremental encoder for receiving the digital output signal from said digital incremental encoder and, in response thereto, operating and controlling said motor of said drive arrangement such that the desired tensioning force is automatically and accurately applied and maintained on the string so as to produce the tensioned string.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE PRESENT INVENTION

Figure 1:
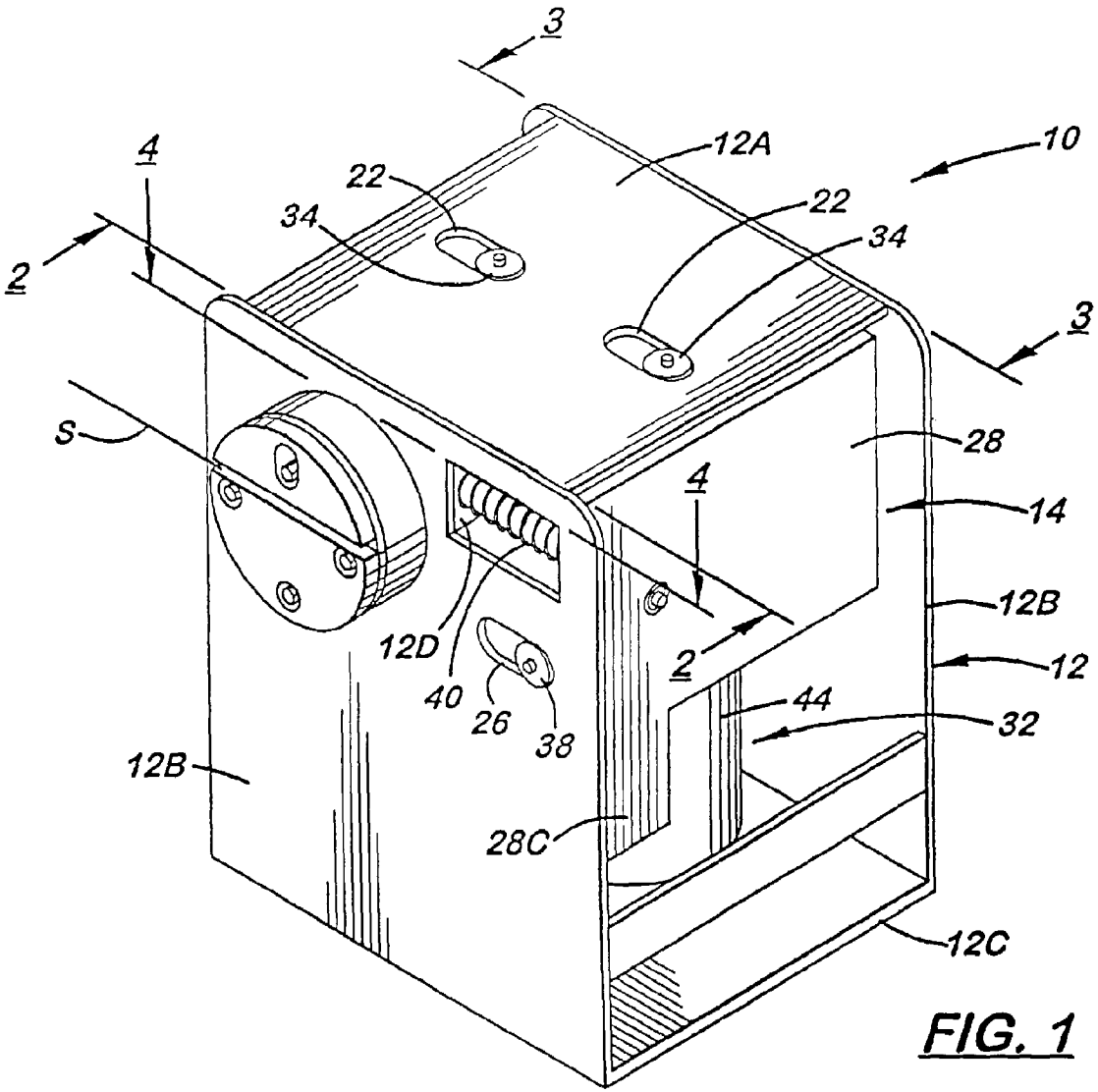
FIG. 1 is a perspective view of a first embodiment of a string tensioning force controlling apparatus of the present invention.
Figure 3:
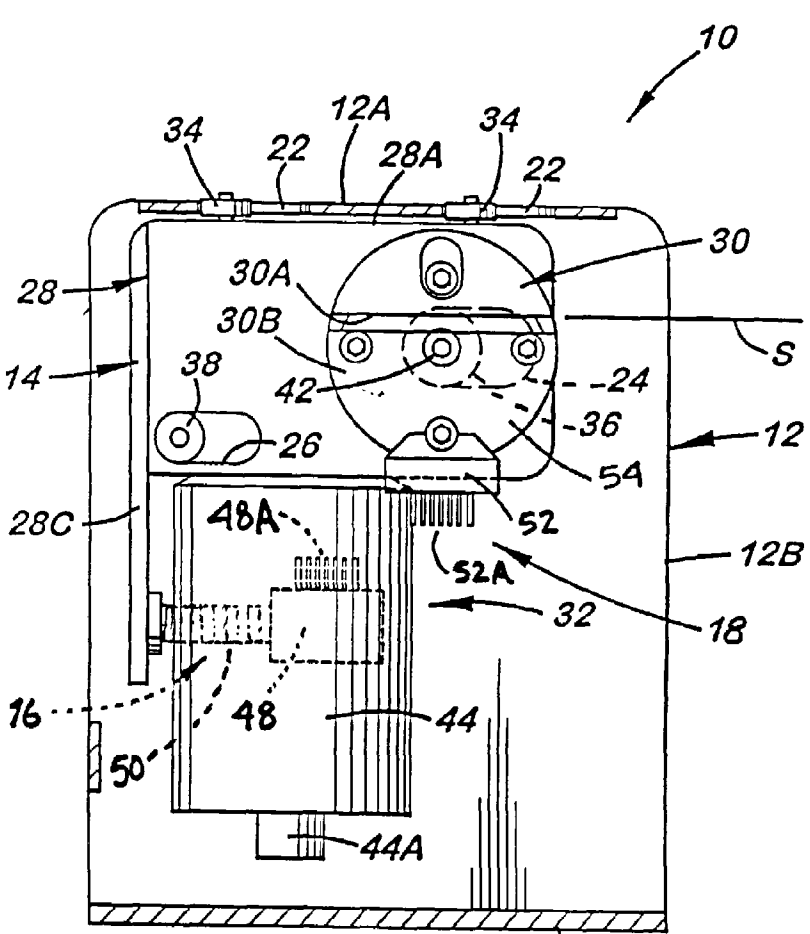
FIG. 3 is a right side elevational, partly sectional, view of the apparatus taken along line 3—3 of FIG. 1.

In the following description, like reference characters designate like or corresponding parts throughout the several views of the drawings. Also in the following description, it is to be understood that such terms as "forward", "rearward", "left", "right", "upwardly", "downwardly", and the like are words of convenience and are not to be construed as limiting terms.

Referring to the drawings and particularly to FIGS. 1–5, there is illustrated a first embodiment of a string tensioning force controlling apparatus, generally designated 10, of the present invention, for use in an otherwise conventional racket stringer. The string tensioning force controlling apparatus 10 of the present invention basically includes a base seat or housing 12 which is stationarily positioned, a string pulling mechanism 14 mounted to the base housing 12, first and second encoders 16,18 which are associated with the string pulling mechanism 14 and base housing 12, and a central processing unit 20 connected to detection means in the form of first and second encoders 16, 18 and to the string pulling mechanism 14.

The base housing 12 of the apparatus 10 has a top wall 12A, a pair of opposite side walls 12B and a bottom wall 12C which are all interconnected such that the base housing 12 is open at its front and back. The base housing 12 further has a pair of slide slots 22 defined in the top wall 12A and pairs of slide slots 24, 26 defined in the opposite side walls 12B.

Figure 2:
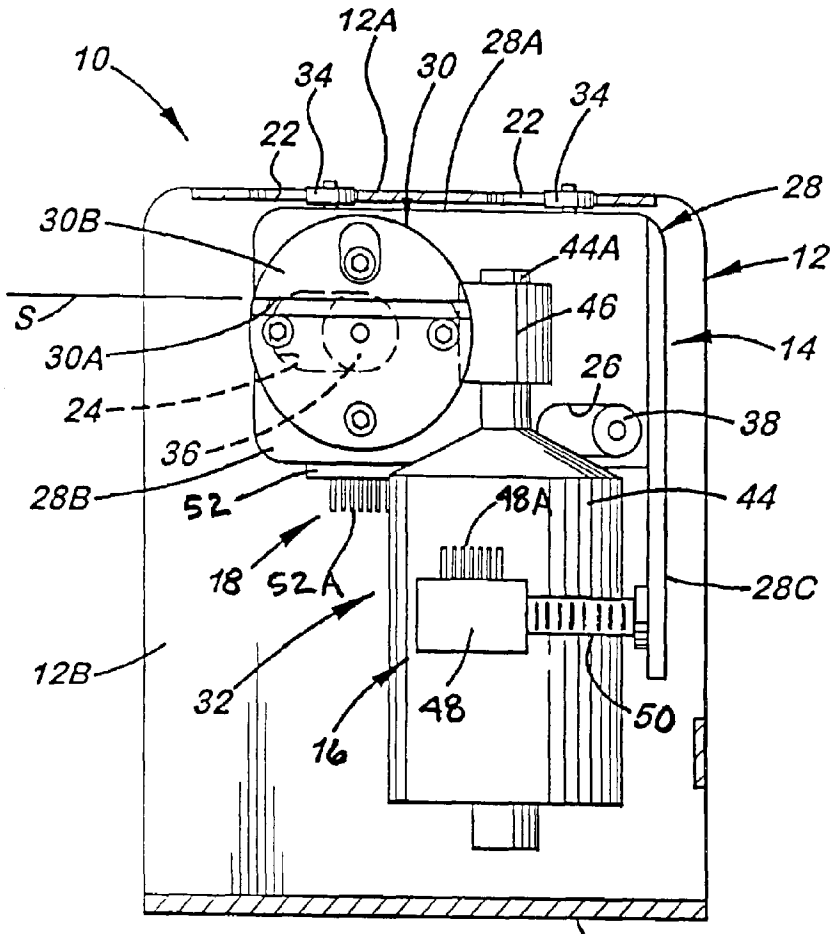
FIG. 2 is a left side elevational, partly sectional, view of the apparatus taken along line 2—2 of FIG. 1, showing a spring pulling mechanism and first and second encoders of the apparatus at first positions.
Figure 4:
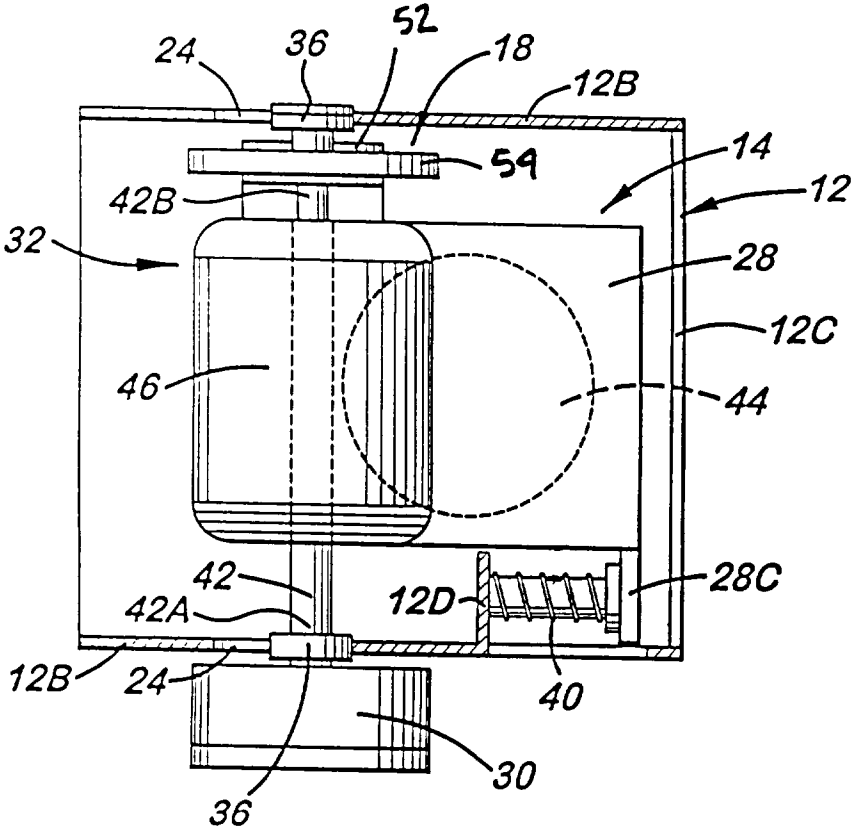
FIG. 4 is a top plan, partly sectional, view taken along line 4—4 of FIG. 1.
Figure 6:
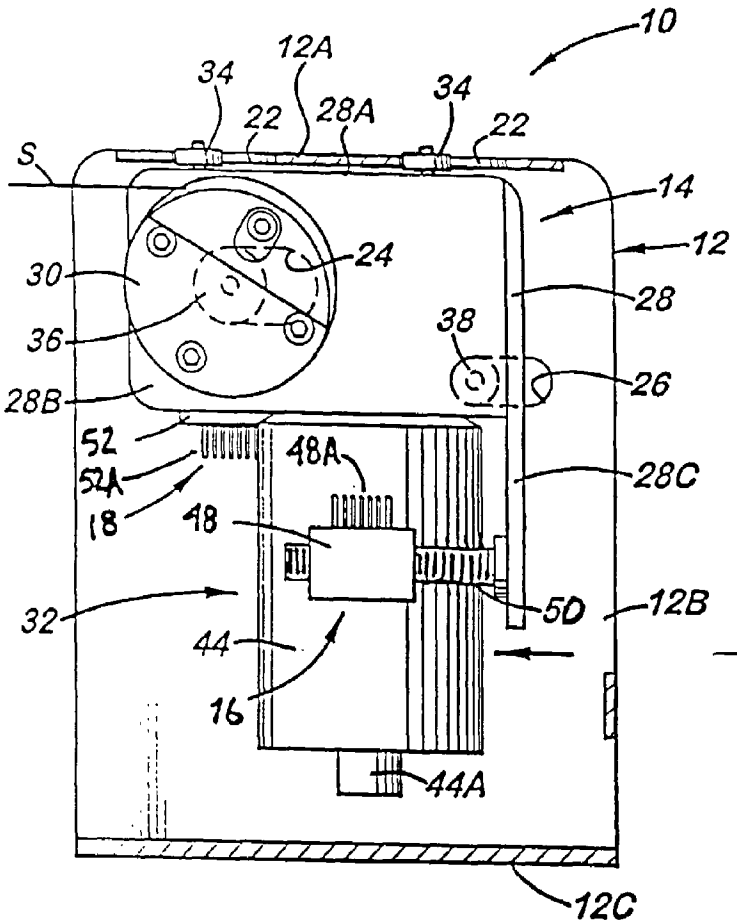
FIG. 6 is a view similar to that of FIG. 2 showing the spring pulling mechanism and first and second encoders of the apparatus at second positions.

The string pulling mechanism 14 of the apparatus 10 includes a support housing 28, a string pulling head 30 and a drive arrangement 32. The support housing 28 of the string pulling mechanism 14 has a top 28A and a pair of opposite sides 28B and is linearly slidably mounted to the base housing 12 for undergoing substantially linear displacement relative thereto by a pair of bearings 34 rotatably mounted adjacent the top 28A of the support housing 28 and by pairs of bearings 36, 38 rotatably mounted adjacent respective opposite sides 28B of the support housing 28 which are disposed and movable within the respective slide slots 22, 24, 26 of the respective top and opposite side walls 12A, 12B of the base housing 12. The support housing 28 also is biased toward a first position relative to the base housing 12, as seen in FIG. 2, by biasing means in the form of a coil spring 40 disposed between spaced apart portions 28C and 12D of the support housing 28 and base housing 12, as best seen in FIG. 4. The coil spring 40 also is adapted to yield to allow the support housing 28 to undergo linear displacement toward a second position relative to the base housing 12, as seen in FIG. 6. During the displacement of the string pulling mechanism 14 from the first position of FIG. 2 to the second position of FIG. 6, the coil spring 40 is linearly compressed, as can be seen in FIG. 6.

The drive arrangement 32 of the apparatus 10 includes an elongated output shaft 42 disposed through the support housing 28 and mounted at its opposite ends 42A, 42B to one pair of bearings 36 which are disposed and movable within the pair of slide slots 24 in the opposite side walls 12B of the base housing 12. The other bearings 34, 38 are rotatably mounted directly to the top and opposite side walls 28A, 28B of the support housing 28. The string pulling head 30 is attached to the one opposite end 42A of the shaft 42 outwardly from one of the bearings 36 along the exterior of the one side wall 12B of the housing 12. The drive arrangement 32 also includes a motor 44, such as a conventional electric motor, mounted to the support housing 28 and having a rotary output shaft 44A drivingly connected via a gear box 46 and the shaft 42 to the string pulling head 30 for causing selected rotation of the string pulling head 30 in either of clockwise or counterclockwise directions in response to selected operation of the motor 44. Thus, the string pulling head 30 of the string pulling mechanism 14 is mounted on the base housing 12 for undergoing rotational displacement relative to the support housing 28 for undergoing rotational displacement relative thereto. The string pulling head 30 can have a cylindrical configuration and a diametrical slot 30A defined across its outer end 30B which is adapted to receive a portion of a racket string S and engage it with the string pulling head 30 such that rotation of the head 30 twists the string S and applies a string tensioning force to the string S to produce a tensioned string S. The support housing 28, by being linearly movably mounted on the base housing 12, can undergo linear displacement relative thereto in response to a force of the tensioned string S being applied on the support housing 28 via the string pulling head 30.

The first encoder 16 is disposed adjacent to the string pulling mechanism 14 and connected to the central processing unit 20 such that the first encoder 16 detects the linear displacement of the support housing 28 relative to the base housing 12 and generates a digital output signal representative of the linear displacement. The digital signal generated by the first encoder 16 is received by the central processing unit 20 and in response thereto the central processing unit 20 controls the operation of the motor 44 so as to control the movement of the string pulling head 30 relative to the support housing 28 to maintain the application of the desired tensioning force on the string S which is an input to the central processing unit 20 by the user. The first encoder 16 includes a sensor member 48 having wires 48A connected to the central processing unit 20 and a sensed member 50. The sensor member 48 is mounted on the base housing 12 and the sensed member 50 is connected to the support housing 28 such that in response to the linear displacement of the support housing 28 the sensed member 50 is linearly displaced and the sensor member 48 detects the linear displacement of the sensed member 50 and generates the digital output signal. Since the sensor member 48 is mounted to the fixed housing 12, the sensor member wires 48A do not move because the base member 12 is fixed and thus eliminates the wear experienced in the prior art devices.

The central processing unit 20 of the apparatus 10, which can be any suitable device such as a conventional microprocessor, is adapted to accept an input instruction representing the desired tensioning force to be applied to the string, for example fifty pounds. Central processing unit 20 is connected to the motor 44 of the drive arrangement 32 and to the first encoder 16, via sensor wires 48A, and receives the digital output signal from the sensor member 48 of the first encoder 16. In response to the digital signal from the first encoder 16, the central processing unit 20 operates the motor 44 of the drive arrangement 32 such that a desired tensioning force is automatically and accurately applied on the string S so as to produce a desired poundage or tensioned condition in the string S.

The second encoder 18 of the apparatus 10 is disposed adjacent to the string pulling mechanism 14 such that the second encoder 18 detects the rotational displacement of the output shaft 42, via the string pulling head 30 which is coaxially fixed to the output shaft 42, relative to the support housing 28 and generates another digital output signal representative of the rotational displacement. The second encoder 18 includes a sensor member 52 and a sensed member 54. The sensor member 52 is mounted to the support housing 28 adjacent to the string pulling head 30 and the sensed member 54 is mounted to the other end 42B of the shaft 42 adjacent to the interior of the other side wall 12B of the base housing 12 so that rotational displacement of the string pulling head 30 will, in turn, rotationally displace the sensed member 54 relative to the sensor member 52 such that the sensor member 52 detects the rotation displacement of the sensed member 54 and thereby of the string pulling head 30 and generates the other digital output signal. The sensed member 54 can be an encoder disk coaxially connected with the string pulling head 30 for the rotational displacement therewith.

The first and second encoders 16, 18 of the apparatus 10 can be any suitable conventional devices, such as optical types of encoders, which generate a digital signal. Preferably, the digital encoders 16, 18 are of the incremental type rather than of the absolute type. The working principle of an optical encoder is that its sensed member is formed with multiple slits at known intervals (such as 14 slits within 1 mm length). The sensor member has a light emitting element and a photosensor respectively on two sides of the slits. When the slits of the sensed member pass through the sensor member, the light emitted by the light emitting element will pass through the slits and be intermittently received by the photosensor. Then, the digital output signal is generated. The optical encoders of the preferred incremental type are used in a way to provide a signal to the central processing unit after each slit passes by the sensor member. The central processing unit 20 reads each signal that is received and compares the consecutive signals received as the support housing 28 moves relative to the base housing 12 (as shown in FIG. 6) to the signal received prior to the movement of the support housing 28 (as shown in FIG. 2). The difference in these signals is compared to the desired tension input to the central processing unit so as to control the drive arrangement 32 to reach and maintain the desired tension level. This type of encoder is well-known in the prior art and thus need not be further described herein.

Figure 5:
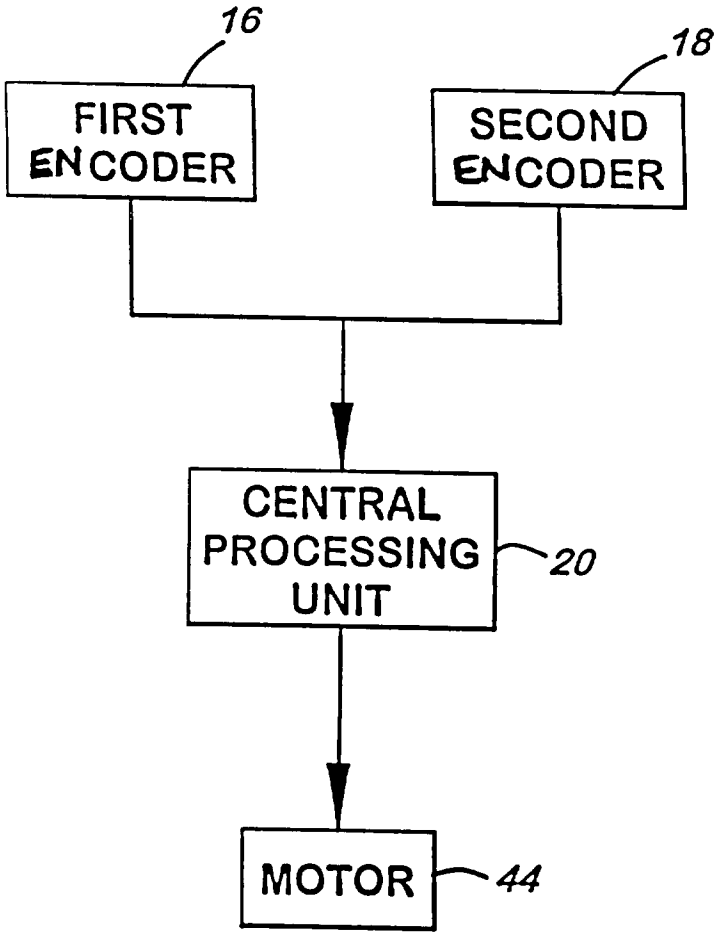
FIG. 5 is a block diagram of the arrangement of a central processing unit, first and second encoders and a motor of the apparatus.

Thus, as seen in FIG. 5, the central processing unit 20 receives the respective digital output signals of the first and second encoders 16, 18 and controls the operation of the motor 44 of the drive arrangement 32 of the string pulling mechanism 14 to cause the desired rotational displacement of the string pulling head 30 and produce the desired poundage or tensioned condition in the string S. The central processing unit 20 can accurately control the operation of the motor 44 whereby the rotational speed of the string pulling head 30 can be varied in accordance with the characteristics of different materials of strings. When the central processing unit 20 knows from the displacement signal generated from the first encoder 16 that the string pulling head 30 has tensioned the racket string S to a predetermined poundage, the central processing unit 20, via the detection of the second encoder 18, controls the rotational displacement of the string pulling head 30 to be zero. That is, the motor 44 is controlled to lock and prevent the string pulling head 30 from further rotating. However, after the racket string S is tensioned, the string S will exert a reverse action force onto the string pulling head 30 to pull the same in the reverse direction. When the string pulling head 30 is reversely pulled, the second encoder 18 will detect the negative rotational displacement and send out a digital output signal to control the motor 44 to further rotate so as to rectify the negative rotational displacement of the string pulling head 30. Therefore, the poundage of the racket string can be kept in the predetermined value without changing.

The signals output by the first and second encoders 16, 18 are digital signals which can be directly used by the central processing unit 20 without being further decoded by a decoder as in the conventional apparatus. Therefore, no error of decoding will take place. Moreover, the first and second encoders 16, 18 detect the linear displacement of the support housing 28 of the string pulling mechanism 14 and the rotational displacement of the string pulling head 30 to generate corresponding signals, unlike the operation of the strain meter of the conventional apparatus. Therefore, the error resulted from the magnification of action force by the force arm can be avoided.

Figure 7:
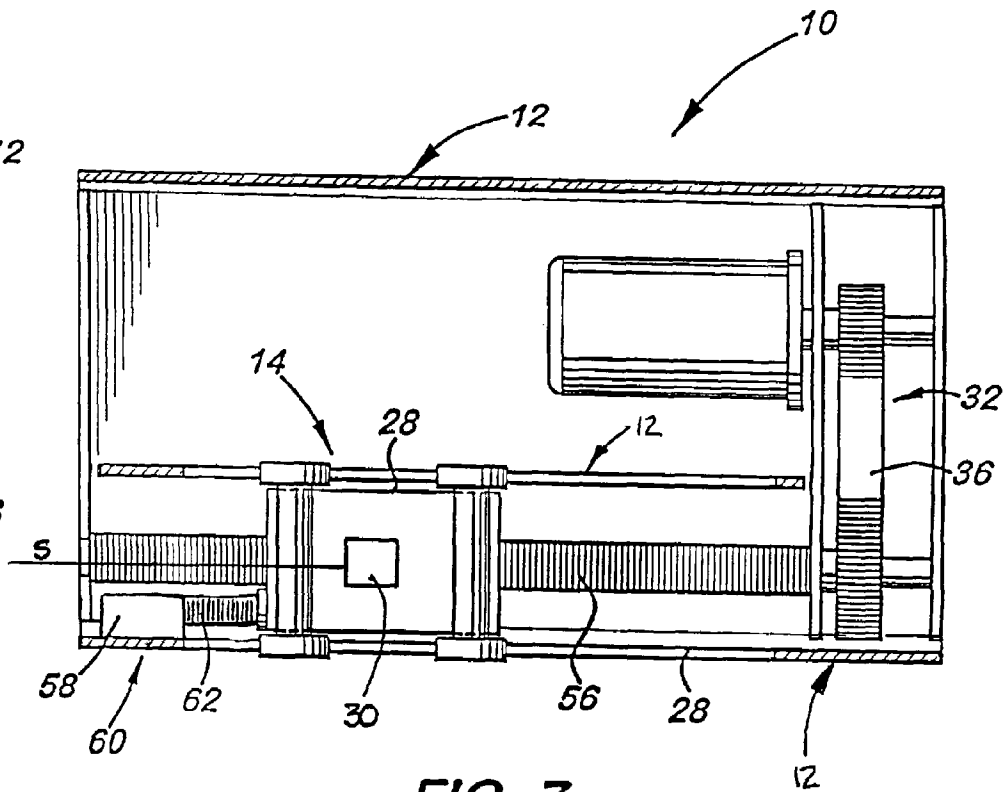
FIG. 7 is a top plan, partly sectional, view of a second embodiment of the apparatus of the present invention.

Referring to FIG. 7, there is illustrated a second embodiment of the apparatus 10 of the present invention in which the string pulling mechanism 14 is fixed on the base seat or housing 12. The drive arrangement 32 of the string pulling mechanism 14 includes a worm or screw shaft 56 rotatably driven by the motor 44 to linearly move the string pulling head 30 and tension the racket string S. A sensor member 58 of an encoder 60 is mounted on the base housing 12, while a sensed member 62 of the encoder 60 is connected with the string pulling head 30. In this second embodiment, encoder 60 operates in the same fashion as the first encoder 16 in the first embodiment described above to detect linear displacement. During the linear travel or displacement of the string pulling head 30, the sensed member 62 of the encoder 60 is linearly driven and displaced. The sensor member 58 of the encoder 60 detects the linear displacement of the sensed member 62 and generates a digital output signal to the central processing unit 20 of FIG. 5. The central processing unit 20 controls the operation of the motor 44 so as to vary the moving speed and stop movement of the string pulling head 30. Also, the string pulling head 30 can be locked in a true position and the poundage by which the string pulling head 30 tensions the racket string S can be detected. Additionally, but not shown, this second embodiment of the present invention could have a second encoder (not shown) associated with the motor 44 in a fashion similar to that of the second encoder 18 shown in the first embodiment.

Figure 8:
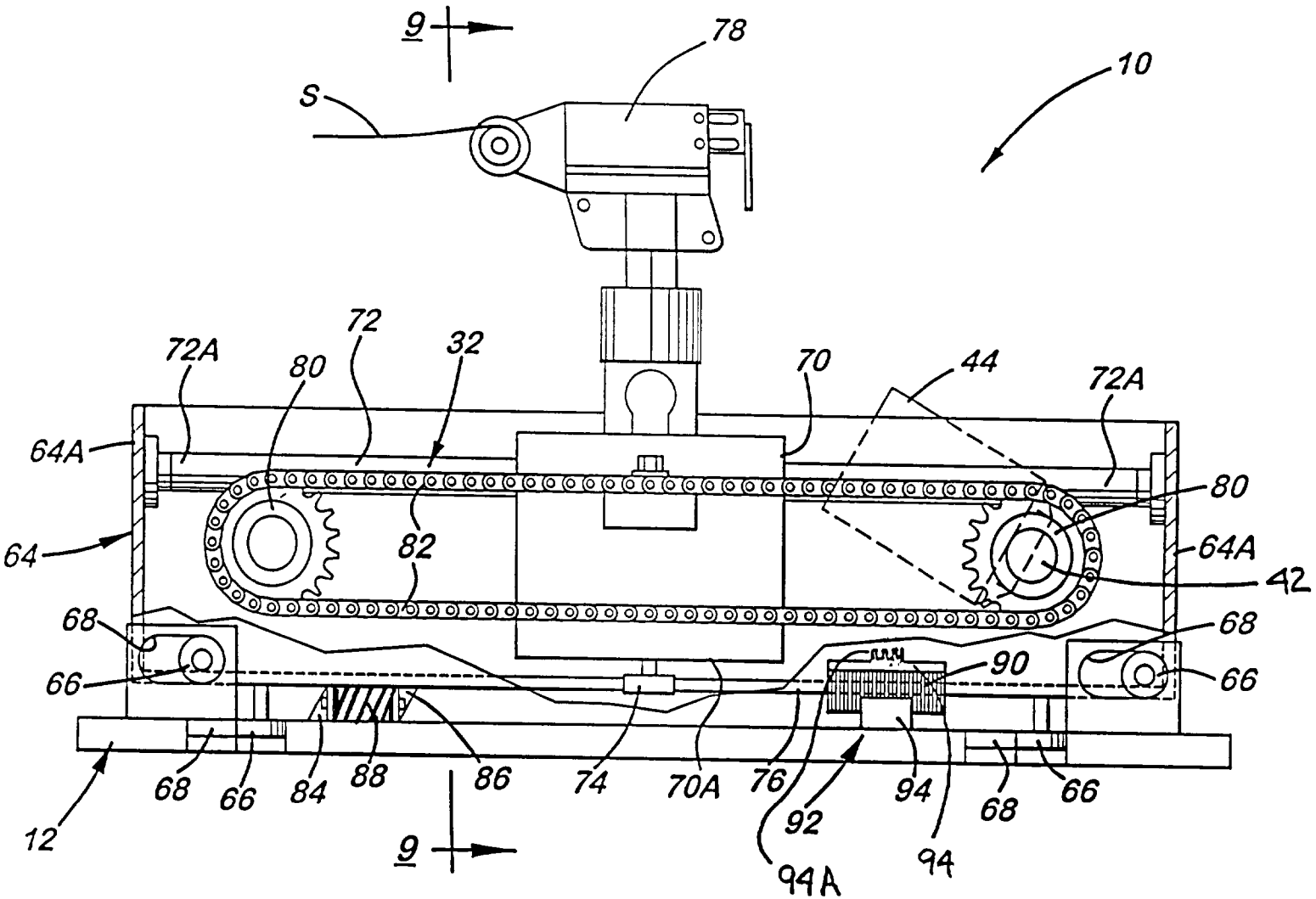
FIG. 8 is a side elevational, partly sectional, view of a third embodiment of the apparatus of the present invention.
Figure 9:
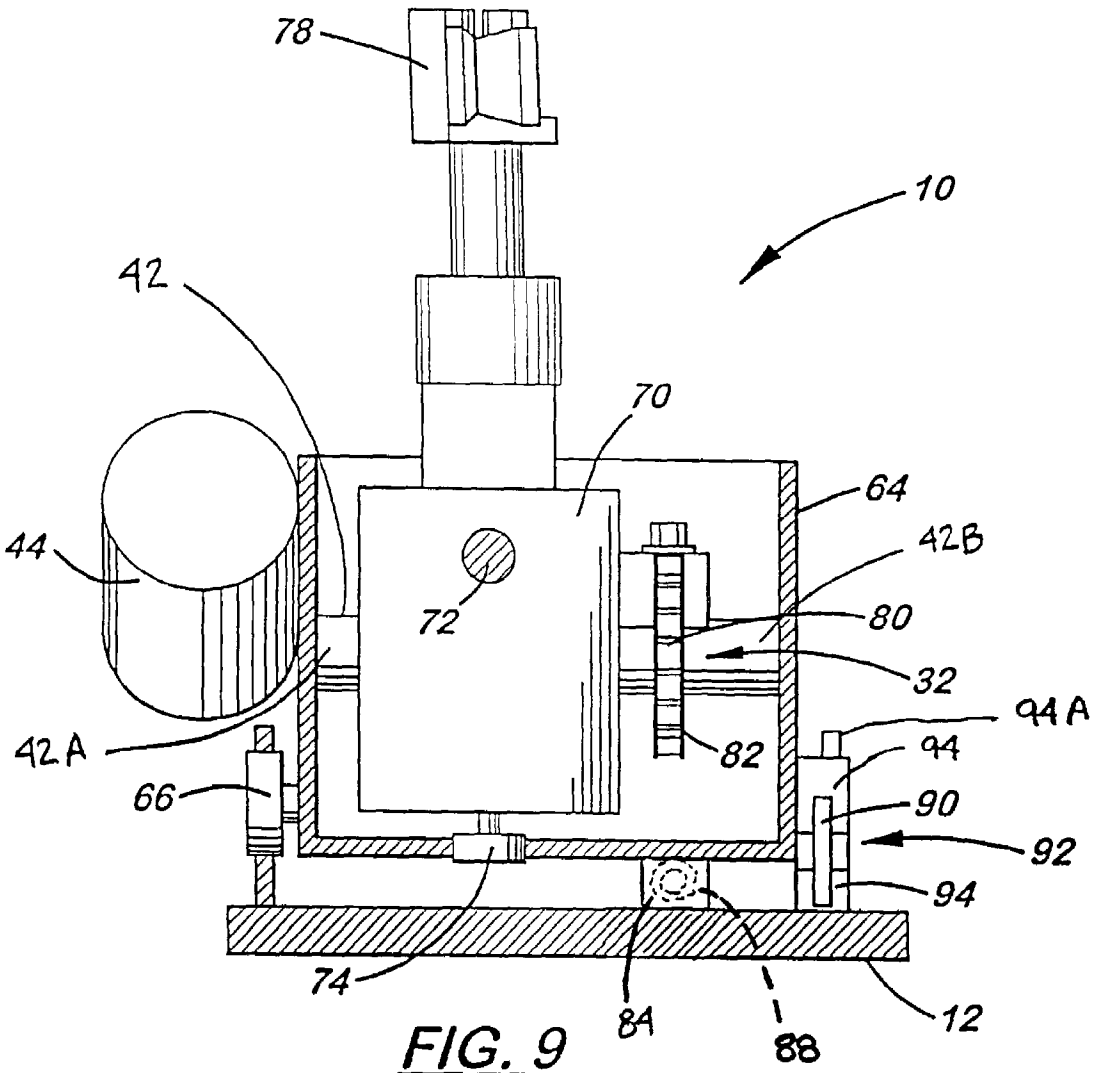
FIG. 9 is a vertical sectional view of the apparatus taken along line 9—9 of FIG. 8.

Referring to FIGS. 8 and 9, there is illustrated a third embodiment of the apparatus 10 of the present invention in which the string pulling mechanism 14 is mounted on the base seat or housing 12. The string pulling mechanism 14 includes a slide seat or housing 64. Several bearings 66 are disposed respectively along two sides and the bottom of the slide housing 64. The base housing 12 has several slide slots 68 defined therein which respectively receive the bearings 66, whereby the string pulling mechanism 14 can be linearly moved or displaced on the base housing 12. The string pulling mechanism 14 also includes a string pulling seat or housing 70 disposed in the slide housing 64 and a slide rail 72 passed through the string pulling housing 70. The two opposite ends 72A of the slide rail 72 are fixedly mounted on the opposite walls 64A of the slide housing 64. A bearing 74 is mounted on a bottom wall 70A of the string pulling housing 70. The slide housing 64 has a slide slot 76 defined therein receiving the bearing 74. Under limitation of the slide rail 72 and the bearing 74 and slide slot 76, the string pulling housing 70 can be linearly moved or displaced within the slide housing 64. A string pulling head 78 is stationarily mounted on the string pulling housing 70 for tensioning the racket string S. The motor 44 of the drive arrangement 32 is positioned on one side of the slide housing 64 for driving one of a pair of sprockets 80 and an endless chain 82 of the drive arrangement 32 is entrained over the sprockets 80. The sprockets 80 are rotatably mounted in the slide housing 64. The string pulling housing 70 is coupled with the chain 82 such that when the motor 44 rotatably drives the one sprocket 80 and thereby the chain 82, the string pulling housing 70 is linearly driven and moved or displaced, whereby the string pulling head 78 can tension the string S. In addition, a lower stop plate 84 is mounted on the base housing 12. The slide housing 64 is provided with an upper stop plate 86 mounted thereto and spaced from the lower stop plate 84. Detection means in the form of a coil spring 88 (similar to coil spring 40 of the first embodiment) is disposed between the lower and upper stop plates 84, 86. During the travel or displacement of the string pulling mechanism 14, the coil spring 88 is compressed.

A sensed member 90 of an encoder 92 (similar to the first encoder 16 of the first embodiment) is fixedly mounted on the slide housing 64, while a sensor member 94 of the encoder 92 is fixedly mounted on the base housing 12.

During the travel or displacement of the string pulling mechanism 14, the slide housing 64 moves the sensed member 90 of the encoder 92 relative to the sensor member 94 thereof. The sensor member 94 of the encoder 92 detects the linear displacement of the sensed member 90 and generates a digital output signal to the central processing unit 20 of FIG. 5. The central processing unit 20 controls the operation of the motor 44 to detect the poundage by which the string pulling head 78 tensions the racket string S. Additionally, but not shown, this third embodiment of the present invention could have a second encoder (not shown) associated with the motor 44 in a fashion similar to that of the second encoder 18 shown in the first embodiment.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiments thereof.

I claim:

1. A string tensioning force controlling apparatus for a racket stringer, comprising: (a) a fixed base housing; (b) a string pulling mechanism having a support housing, a drive arrangement supported on said support housing, and a string pulling head adapted to engage a string and mounted on said support housing, said drive arrangement including a motor mounted to said support housing and having a rotary output shaft drivingly connected to said string pulling head for rotating said string pulling head in response to operation of said motor, said string pulling head also drivingly coupled to said drive arrangement and in response to operation of said drive arrangement adapted to apply a desired tensioning force on the string to produce a tensioned string, said support housing movably mounted on said fixed base housing for undergoing displacement relative to said fixed base housing in response to a force of the tensioned string being applied on said support housing via said string pulling head; (c) biasing means disposed between said support housing and said fixed base housing and adapted to bias said support housing to undergo displacement toward a first position relative to said base housing and to yield to allow said support housing to undergo displacement toward a second position relative to said fixed base housing upon applying said string tension force; (d) detection means disposed adjacent to said string pulling mechanism for detecting the displacement of said string pulling mechanism relative to said fixed base housing and generating an output signal representative of the displacement; (e) a central processing unit connected to said drive arrangement and to said detection means for receiving the output signal from said detection means and, in response thereto, operating said drive arrangement such that the desired tensioning force is accurately applied on the string so as to produce the tensioned string; and (f) a digital encoder disposed adjacent to said string pulling mechanism to detect the rotational displacement of said string pulling head relative to said support housing and to generate a second digital output signal representative of the rotational displacement to said central processing unit for controlling the operation of said motor.

2. The apparatus as recited in claim 1, wherein said digital encoder includes a sensor member and a sensed member, said sensed member being mounted to said string pulling head and said sensor member being mounted to said support housing whereby said displacement of said string pulling head displaces said sensed member relative to said sensor member such that said sensor member detects the displacement of said string pulling head and generates said digital output signal.

3. The apparatus as recited in claim 2, wherein said digital encoder is an incremental encoder.

4. The apparatus as recited in claim 1, wherein said string pulling head of said string pulling mechanism is rotatable.

5. The apparatus as recited in claim 1, wherein said string pulling head of said string pulling mechanism is movable linearly along said support housing.

6. The apparatus as recited in claim 1, wherein: said drive arrangement includes a motor mounted to said support housing and having a rotary output shaft drivingly connected to said string pulling head for moving said string pulling head linearly along said support housing in response to operation of said motor.

7. The apparatus as recited in claim 1, wherein said drive arrangement includes a pair of sprockets mounted to said support housing and a chain entrained over and extending between said sprockets and drivingly coupled to said string pulling head.

8. The apparatus as recited in claim 7, wherein said drive arrangement further includes a motor drivingly coupled to one of said sprockets such that operation of said motor rotates said one sprocket causing movement of said chain which, in turn, causes said string pulling head to move linearly to tension said string.

9. The apparatus as recited in claim 1, wherein said biasing means is a coil spring.

10. The apparatus as recited in claim 1, wherein said detection means is a digital encoder having a sensor member and a sensed member, said sensed member being mounted on said support housing and said sensor member being connected to said fixed base housing such that in response to the displacement of said support housing said sensed member is displaced and said sensor member detects the displacement of said sensed member and generates the digital output signal.

11. The apparatus as recited in claim 10, wherein said digital encoder is an incremental encoder.

12. A string tensioning force controlling apparatus for a racket stringer, comprising: (a) a fixed base housing; (b) a string pulling mechanism having a support housing, a drive arrangement supported on said support housing, and a string pulling head adapted to engage a string and mounted on said support housing, said string pulling head also drivingly coupled to said drive arrangement and in response to operation of said drive arrangement adapted to apply a desired tensioning force on the string to produce a tensioned string, said support housing movably mounted on said fixed base housing for undergoing linear displacement relative to said fixed base housing in response to a force of the tensioned string being applied on said support housing via said string pulling head; (c) biasing means disposed between said support housing and said fixed base housing and adapted to bias said support housing to undergo linear displacement toward a first position relative to said base housing and to yield to allow said support housing to undergo linear displacement toward a second position relative to said fixed base housing upon applying said string tension force; (d) a first encoder disposed adjacent to said string pulling mechanism for detecting the displacement of said string pulling mechanism relative to said base housing and generating a first output signal representative of the linear displacement, said first encoder including a sensor member and a sensed member, said sensed member being mounted on said support housing and said sensor member being connected to said fixed based housing such that in response to the linear displacement of said support housing said sensed member is linearly displaced and said sensor member detects the linear displacement of said sensed member and generates the first output signal; and (e) a central processing unit connected to said drive arrangement and to said first encoder for receiving the output signal from said first encoder and, in response thereto, operating said drive arrangement such that the desired tensioning force is automatically and accurately applied on the string so as to produce the tensioned string.

13. The apparatus as recited in claim 12, wherein said biasing means is a coil spring.

14. The apparatus as recited in claim 12, wherein said first encoder is an incremental encoder which generates a digital output signal.

15. The apparatus as recited in claim 12, wherein said drive arrangement includes a motor mounted to said support housing and having a rotary output shaft drivingly connected to said string pulling head for operating said string pulling head in response to operation of said motor.

16. The apparatus as recited in claim 15, further comprising: a second encoder disposed adjacent to said string pulling mechanism to detect the rotational displacement of said rotary output shaft relative to said support housing and to generate a second output signal representative of the rotational displacement to said central processing unit for controlling the operation of said motor.

17. The apparatus as recited in claim 16, wherein said first and second encoders are digital encoders.

18. A string tensioning force controlling apparatus for a racket stringer, comprising: (a) a fixed base housing; (b) a string pulling mechanism having a support housing, a drive arrangement supported on said support housing, and a string pulling head adapted to engage a string and mounted on said support housing, said drive arrangement including a motor mounted to said support housing and having a rotary output shaft drivingly connected to said string pulling head for moving said string pulling head in response to operation of said motor to apply a desired tensioning force on the string to produce a tensioned string, said support housing movably mounted on said fixed base housing for undergoing linear displacement relative to said fixed base housing in response to a force of the tensioned string being applied on said support housing via said string pulling head; (c) biasing means disposed between said support housing and said fixed base housing and adapted to bias said support housing to undergo linear displacement toward a first position relative to said base housing and to yield to allow said support housing to undergo linear displacement toward a second position relative to said fixed base housing upon applying said string tension force; (d) a first encoder disposed adjacent to said string pulling mechanism for detecting the linear displacement of said support housing relative to said fixed base housing and generating a first output signal representative of the linear displacement; (e) a second encoder disposed adjacent to said string pulling mechanism for detecting the rotational displacement of the output shaft of said motor relative to said support housing and generating a second output signal representative of the rotational displacement; and (f) a central processing unit connected to said drive arrangement and to said first encoder for receiving the first output signal from said first encoder and to said second encoder for receiving the second output signal from said second encoder and, in response thereto, operating and controlling said drive arrangement such that the desired tensioning force is accurately applied and maintained on the string so as to produce the tensioned string.

19. The apparatus as recited in claim 18, wherein said biasing means is a coil spring.

20. The apparatus as recited in claim 18, wherein said first and second encoders are incremental digital encoders.

21. The apparatus as recited in claim 18, wherein said first encoder includes a first sensor member and a first sensed member, said first sensed member being mounted to said string pulling head and said first sensor member being mounted to said support housing whereby said linear displacement of said string pulling head displaces said first sensed member relative to said first sensor member such that said first sensor member detects the linear displacement of said string pulling head and generates said first output signal.

22. The apparatus as recited in claim 21, wherein said second encoder has a second sensor member and a second sensed member, said second sensed member being mounted to said rotary output shaft of said motor and said second sensor member being mounted to said support housing whereby said rotational displacement of said output shaft rotationally displaces said second sensed member relative to said sensor member such that said second sensor detects the rotation displacement of said second sensed member and thereby rotary displacement of said output shaft and generates said second digital output signal.

23. A string tensioning force controlling apparatus for a racket stringer, comprising: (a) a base housing; (b) a string pulling mechanism having a support housing, a string pulling head and a drive arrangement, said string pulling head mounted on said support housing and adapted to engage a string, said drive arrangement including a motor mounted to said support housing and having a rotary output shaft drivingly connected to said string pulling head for moving said string pulling head in response to operation of said motor to apply a desired tensioning force on the string so as to produce a tensioned string; (c) a digital encoder disposed adjacent to said string pulling mechanism for detecting the rotational displacement of the output shaft of said motor relative to said support housing and generating a digital output signal representative of the rotational displacement; and (d) a central processing unit connected to said drive arrangement and to said digital encoder for receiving the digital output signal from said digital encoder and, in response thereto, operating and controlling said motor of said drive arrangement such that the desired tensioning force is accurately applied and maintained on the string so as to produce the tensioned string.

24. The apparatus as recited in claim 23, wherein said digital encoder is an incremental digital encoder.

* * * * *